United States Patent [19]

Udelhofen

[11] Patent Number: 4,819,303

[45] Date of Patent: Apr. 11, 1989

[54] BELT LOOP STAY

[75] Inventor: Mark J. Udelhofen, Park Ridge, Ill.

[73] Assignee: Illinois Tool Works Inc., Chicago, Ill.

[21] Appl. No.: 103,660

[22] Filed: Oct. 2, 1987

[51] Int. Cl.[4] ..... A44B 11/00

[52] U.S. Cl. ..... 24/182; 24/176; 24/543

[58] Field of Search ..... 24/182, 168, 122, 369, 24/176, 190, 349, 2.5, 3 K, 543, 49, 489, 67.9; 224/247, 166; 2/271, 336, 236; 297/479

[56] References Cited

U.S. PATENT DOCUMENTS

| | | | |
|---|---|---|---|
| 518,575 | 4/1894 | Whipple | 24/182 |
| 884,207 | 4/1908 | Reichert | 24/176 |
| 1,597,056 | 8/1926 | Cloud | 24/543 |
| 1,682,536 | 8/1928 | Otten | 24/543 |
| 2,490,405 | 12/1949 | Bloom et al. | 24/543 |
| 2,641,812 | 6/1953 | Boudreau | 24/182 |
| 3,551,965 | 1/1971 | Gordon | 24/543 |
| 3,646,644 | 3/1972 | Watts | 24/168 |
| 3,789,431 | 2/1974 | Rand | 2/271 |
| 4,055,874 | 11/1977 | Brown | 24/67.9 |
| 4,406,043 | 9/1983 | Friedman | 24/182 |
| 4,523,353 | 6/1985 | Hubbard et al. | 24/543 |

FOREIGN PATENT DOCUMENTS

| | | | |
|---|---|---|---|
| 0501059 | 2/1939 | United Kingdom | 24/543 |

*Primary Examiner*—Victor N. Sakran

*Attorney, Agent, or Firm*—John P. O'Brien; Thomas W. Buckman

[57] ABSTRACT

An article injection molded from a thermoplastic material, e.g., a polypropylene or acetal polymer, for use as a belt loop stay. A first strip is provided at each end with a flange. When unstressed, the first strip is straight, except for the flanges. A second strip, which is thinner so as to be more flexible, is joined integrally to the flanges, so as to form a closed loop. When unstressed, the second strip is bowed toward the first strip, between the flanges. The first strip has a stiffening rib, which stiffens the first strip against flexing on lateral axes. The second strip has several stiffening ribs, which stiffen the second strip against flexing on longitudinal axes but permit the second strip to flex on lateral axes. Beveled edges on the first strip facilitate insertion of a belt from either side of the first strip.

1 Claim, 1 Drawing Sheet

BELT LOOP STAY

BACKGROUND OF THE INVENTION

This invention pertains to an article for use as a belt loop stay, as in a knapsack, in a gun belt, or an any of a wide range of other products employing belts made of webbing, leather, or other material. A belt loop stay is used to secure a free end of a belt releasably to other portions of the belt.

Conventionally, a belt loop stay is a limp article made of webbing or other material used for belts. Although such an article may be generally satisfactory, it cannot be easily adjusted to accommodate belts of different thicknesses. U.S. Pat. No. 3,789,431 discloses one way to adjust such an article.

Some alternatives have been proposed. As an example of such alternatives, U.S. Pat. No. 1,495,925 discloses a belt loop stay having a flat spring, which biases a free end of a belt against other portions of the belt. A somewhat similar arrangement is disclosed in U.S. Pat. No. 1,100,389. These arrangements are too complicated and too expensive from a manufacturing standpoint. An adjustable harness loop, which pierces a harness strap at opposite ends of the loop, is disclosed in U.S. Pat. No. 546,455. Such a harness loop has limited utility.

There has been a need, to which this invention is addressed, for an improved article for use as a belt loop stay.

SUMMARY OF THE INVENTION

It is a principal object of this invention to provide an improved article for use as a belt loop stay.

Such an article according to this invention can be advantageously fabricated from a polypropylene or acetal polymer, which can be injection molded, or from another thermoplastic material having a spring characteristic and being capable of being flexed repeatedly without cracking. A material having a spring characteristic is a material that can be effectively made into springs.

In accordance with this invention, the article comprises a first strip, which has a flange at each end of the first strip, and which when unstressed is straight where the first strip extends between the flanges. Moreover, the article comprises a second strip, which is more flexible than the first strip, which is joined integrally at each end of the second strip to a different one of the flanges so as to form a closed loop from the first and second strips, and which when unstressed is bowed toward the first strip between the flanges.

Preferably, the first strip has a stiffening rib extending longitudinally between the flanges. The rib may extend additionally along each of the flanges. The rib stiffens the first strip against flexing on lateral axes.

Preferably, the second strip has one or more stiffening ribs extending laterally across the second strip. Each such rib stiffens the second strip against flexing on longitudinal axes but permits the second strip to flex on lateral axes. Such ribs may serve also as knockout pin bosses, which are used to eject the article from a mold.

Preferably, the first strip has beveled edges facing the second strip. Such edges facilitate insertion of a belt from either side of the article.

These and other objects, features, and advantages of this invention will be better understood from the following description of a preferred embodiment of this invention and an alternative embodiment of this invention with reference to the accompanying drawings.

DETAILED DESCRIPTION OF PREFERRED AND ALTERNATIVE EMBODIMENTS

Figure 1:
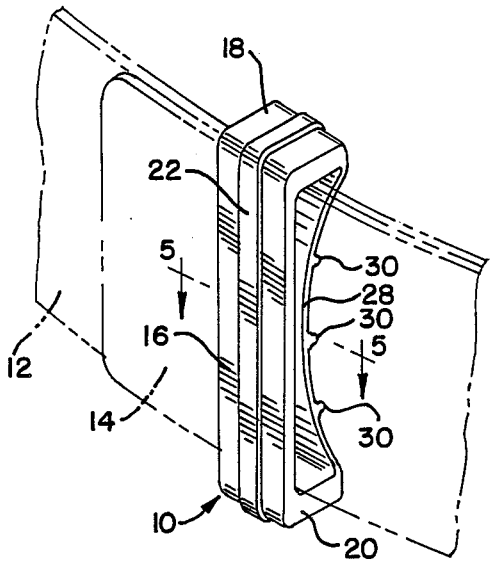
FIG. 1 is a perspective view of a belt loop stay constituting a preferred embodiment of the invention, a free end of a belt and other portions of the belt being lines.

As shown in FIGS. 1 through 5, an article 10 for use as a belt loop stay in conjunction with a belt 12 having a free end 14 may be injection molded from a suitable polymer having a spring characteristic and being capable of being flexed repeatedly without cracking, a polypropylene polymer being preferred. An acetal polymer or other thermoplastic material having a spring characteristic may be alternatively used.

The article 10 comprises a first strip 16, which is provided at its upper end, as shown, with a flange 18 and at its lower end, as shown, with a flange 20. Herein, terms such as "upper" and "lower" refer to the article 10, as shown in FIGS. 1 through 4, but are not intended to limit the article 10 to any particular orientation.

The first strip 16 has a stiffening rib 22, which extends longitudinally between the flanges 18, 20, and which extends additionally along the flange 18, at an upper portion 24 of the stiffening rib 22, as shown, and similarly along the flange 20 at a lower portion 26 of the stiffening rib 22. The stiffening rib 22 stiffens the first strip 16 against flexing on lateral axes (i.e., on axes transverse to the stiffening rib 22). When unstressed, as shown in FIG. 2, the first strip 16 is straight where the first strip 16 extends between the flanges 18, 20.

The article 10 comprises a second strip 28, which is thinner in cross-section when compared to the first strip 16, so as to be more flexible than the first strip 16. The second strip 28 is joined integrally at the upper end of the second strip 28 to the flange 18 and at the lower end of the second strip 28 to the flange 20, so as to form a closed loop from the first strip 16, which includes the flanges 18, 20, and the second strip 28.

Figure 2:
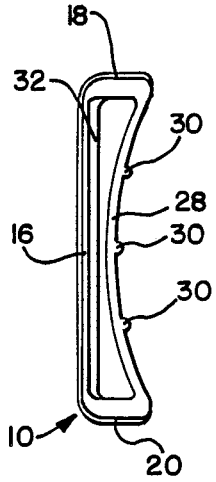
FIGS. 2, 3 and 4 are respectively side, front, and back views of the belt loop stay of FIG. 1.
Figure 3:
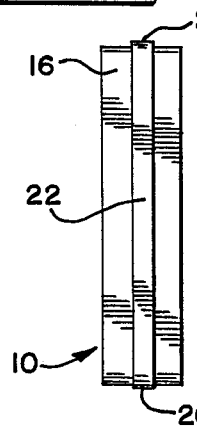
Figure 4:
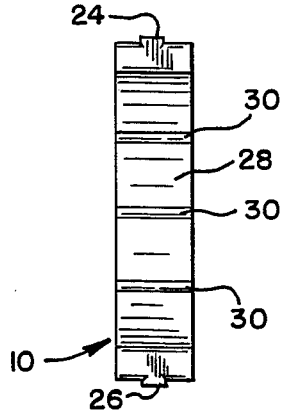

As shown in FIGS. 1, 2, and 4, the second strip 28 has three stiffening ribs 30, which extend laterally across the second strip 28. The stiffening ribs 30 stiffen the second strip 28 against flexing on longitudinal axes (i.e., on axes transverse to the stiffening ribs 30) but permit the second strip 28 to flex on lateral axes (i.e., on axes parallel to the stiffening ribs 30). When unstressed, as shown in FIG. 2, the second strip 28 is bowed toward the first strip 16, between the flanges 18, 20.

Although three stiffening ribs 30 are shown, a greater or lesser number of such ribs may be alternatively used, or such ribs may be entirely omitted. If the article 10 is injection molded, the stiffening ribs 30 serve also as knockout pin bosses, against which knockout pins (not shown) are struck to eject the article 10 from a mold (not shown).

Figure 5:
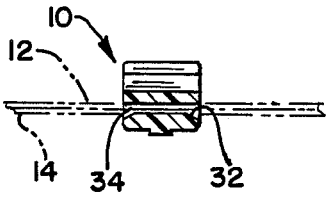
FIG. 5 is a sectional view taken along line 5—5 of FIG. 1 in a direction indicated by arrows, the free end of a belt and other portions of the belt again being shown in phantom lines.

As shown in FIGS. 2 and 5, the first strip 16 has beveled edges 32, 34, which face the second strip 28.

The beveled edges 32, 34, facilitate insertion of a belt, such as the belt 12 shown in phantom lines in FIGS. 1 and 5, from either side of the article 10.

In use, as shown in FIGS. 1 and 5, a belt 12 is passed through the closed loop formed by the first strip 16, which includes the flanges 18, 20, and the second strip 28, whereupon the belt 12 is deployed around a body (not shown) which may be a body of a person, and whereupon the free end 14 of the belt 12 is inserted through the same loop so as to lie against other portions of the belt 12. The article 10 may be readily slipped along the belt 12 to a suitable location to accommodate the free end 14 of the belt 12 without dangling of the free end 14 of the belt 12.

The article 10 flexes, particularly but not exclusively at the second strip 28, which flexes more than the first strip 16 flexes either between the flanges 18, 20, or where the flanges 18, 20 join other portions of the first strip 16, so as to accommodate two layers of the belt 12, one from the free end 14 and another from other portions of the belt 12. Because of the spring characteristic of the material of the article 10, the article 10 presses the free end 14 against other portions of the belt 12. Because the article 10 is capable of flexing, the article 10 adjusts itself to belts of different thicknesses, over a wide range of different thicknesses.

Figure 6:
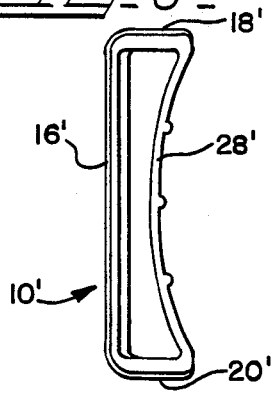
FIG. 6 is an end view of a belt loop stay constituting an alternative embodiment of this invention.

As shown in FIG. 6, an article 10', which comprises a first strip 16' and a second strip 28', is similar to the article 10 in all respects except that, as may be best seen from a comparison between FIGS. 2 and 6, the flanges 18', 20', are longer than the flanges 18, 20, so as to accommodate thicker belts. Analogously, shorter flanges (not shown) would enable such an article to accommodate thinner belts. Furthermore, the first and second strips could be so lengthened or shortened as to accommodate wider or narrower belts.

It is intended by the following claims to cover such modifications and variations as come within the scope and spirit of this invention.

I claim:

1. For use as a belt loop stay, a one-piece article fabricated into a closed loop from a flexible material comprising first and second elongated strips joined together at each end by a flange to define said closed loop, where said first strip when unstressed is straight and substantially in a right angle relationship to the end flanges and where said second strip is more flexible than said first strip and when unstressed is bowed towards said first strip between the end flanges, and a continuous reinforcing rib extending longitudinally along the centerline of the entire length of said strip and along the centerline of the entire length of each of said end flanges, said first and second strips and said end flanges having the same width to provide said closed loop one-piece article with constant width wherein said second strip has a plurality of stiffening ribs extending laterally across said second strip in the middle portion of its length and wherein said first strip has beveled edges facing said second strip.

* * * * *